United States Patent [19]

Mitchell

[11] Patent Number: 4,627,114

[45] Date of Patent: Dec. 9, 1986

[54] SHOCK ATTENUATION STRUCTURE

[75] Inventor: Hal D. Mitchell, Rolla, Mo.

[73] Assignee: Figgie International, Inc., Willoughby, Ohio

[21] Appl. No.: 643,429

[22] Filed: Aug. 23, 1984

[51] Int. Cl.[4] ..... A42B 3/02; F16F 1/00

[52] U.S. Cl. ..... 2/414; 2/420; 267/140; 267/145

[58] Field of Search ..... 2/412, 414, 420, 411, 2/425, 6; 428/304.4, 316.6, 314.8, 315.9; 293/136, 102, 109, 142; 267/140, 145; 36/44

[56] References Cited

U.S. PATENT DOCUMENTS

| | | | |
|---|---|---|---|
| 882,686 | 3/1908 | Ireland et al. . | |
| 1,652,776 | 12/1927 | Galanis . | |
| 3,222,697 | 12/1965 | Scheermesser | 428/316.6 X |
| 3,673,609 | 7/1972 | DeSimone | 2/414 |
| 3,859,666 | 1/1975 | Marietta et al. | 2/412 |
| 4,101,704 | 7/1978 | Hiles | 36/44 X |
| 4,287,613 | 9/1981 | Schulz | 2/414 X |
| 4,343,047 | 8/1982 | Lazowski et al. | 2/411 |
| 4,345,338 | 8/1982 | Frieder, Jr. et al. | 2/414 |
| 4,405,681 | 9/1983 | McEvoy | 428/316.6 X |
| 4,427,189 | 1/1984 | Kimura et al. | 293/136 X |

*Primary Examiner*—Peter Nerbun

*Attorney, Agent, or Firm*—Senniger, Powers, Leavitt and Roedel

[57] ABSTRACT

A shock attenuation structure having a breadth greater than its thickness and a breadthwise cross section comprising a series of layers arranged side-by-side. The series of layers comprises a first plurality of layers of shock-absorbing material having a relatively high resistance to compression and a second plurality of layers of shock-absorbing material having a lower resistance to compression, the layers of the second plurality alternating with the layers of the first plurality across the breadth of the structure and providing lateral support to the layers of the first plurality. The structure is adapted to be mounted with its breadth generally perpendicular to the direction of impact force for broadside loading of the structure during an impact, the layers in the area of impact being adapted to deform for attenuating the shock resulting from the impact.

23 Claims, 6 Drawing Figures

SHOCK ATTENUATION STRUCTURE

BACKGROUND OF THE INVENTION

The present invention relates generally to shock attenuation structure useful in protective headgear (e.g., football and aviation helmets), running shoes and other shock-attenuating applications, and more particularly to such structure wherein shock attenuation is accomplished by the deformation of a series of side-by-side layers having alternating high and low compression resistances.

Various shock attenuation systems have been developed for absorbing shock. Some systems, such as the safety hat shown in U.S. Pat. No. 3,877,076, comprise permanently deformable (i.e., crushable) shock absorbing material, such as foamed polystyrene, which is very effective in attenuating shock but which is not designed to absorb repeated impacts. Other systems comprise resilient shock-absorbing material capable of absorbing repeated impact loadings. However, the use of resilient material may pose a problem in that when it is deformed during an impact, a substantial amount of energy is stored (rather than dissipated) and then released as the material rebounds or returns to its original undeformed shape. This release of energy, sometimes referred to as the "rebound effect", may be transmitted back to the item being protected (e.g., the head in the case of headgear) and result in considerable shock to the item.

Reference may be made to co-assigned U.S. Pat. Nos. 4,558,470; 4,484,364 and 4,534,068 for shock attenuation systems generally in the field of this invention. U.S. Pat. Nos. 882,686, 1,652,776 and 4,343,047 also show various types of shock attenuation apparatus which may be considered generally relevant to the present invention.

SUMMARY OF THE INVENTION

Among the several objects of this invention may be noted the provision of an improved shock attenuation structure wherein shock is attenuated by the deformation of a series of side-by-side layers of shock absorbing material having alternating high and low compression resistances; the provision of such a structure which provides a higher level of shock attenuation than prior systems; the provision of such a structure which continues to provide a higher level of shock attenuation after repeated impact loadings; the provision of such a structure which minimizes the "rebound effect"; and the provision of such a structure which is relatively compact and lightweight compared to prior art systems.

Generally, a shock attenuation structure of the present invention has a breadth greater than its thickness and a breadthwise cross section comprising a series of layers arranged side-by-side comprising a first plurality of layers of shock-absorbing material having a relatively high resistance to compression and a second plurality of layers of shock-absorbing material having a lower resistance to compression, the layers of said second plurality alternating with the layers of said first plurality across the breadth of the structure and providing lateral support to the layers of said first plurality. The structure is adapted to be mounted with its breadth generally perpendicular to the direction of impact force for broadside loading of the structure during an impact, the layers in the area of impact being adapted to deform for attenuating the shock resulting from the impact.

A more specific aspect of the present invention involves protective apparatus for the head comprising a shell of substantially rigid material adapted to fit on the head and a plurality of separate shock attenuating modules disposed around the inside of the shell for protecting the head, at least one of said modules comprising a shock attenuating structure having a breadth greater than its thickness, a breadthwise cross section comprising a series of layers arranged side-by-side, said series comprising a first plurality of layers of shock-absorbing material having a relatively high resistance to compression and a second plurality of layers of shock-absorbing material having a lower resistance to compression, the layers of said second plurality alternating with the layers of said first plurality across the breadth of the structure and providing lateral support to the layers of the first plurality, said structure being mounted on the inside of the shell with its breadth generally perpendicular to the direction of impact force for broadside loading of the structure during an impact, said layers in the area of impact being adapted to deform for attenuating the shock resulting from said impact.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
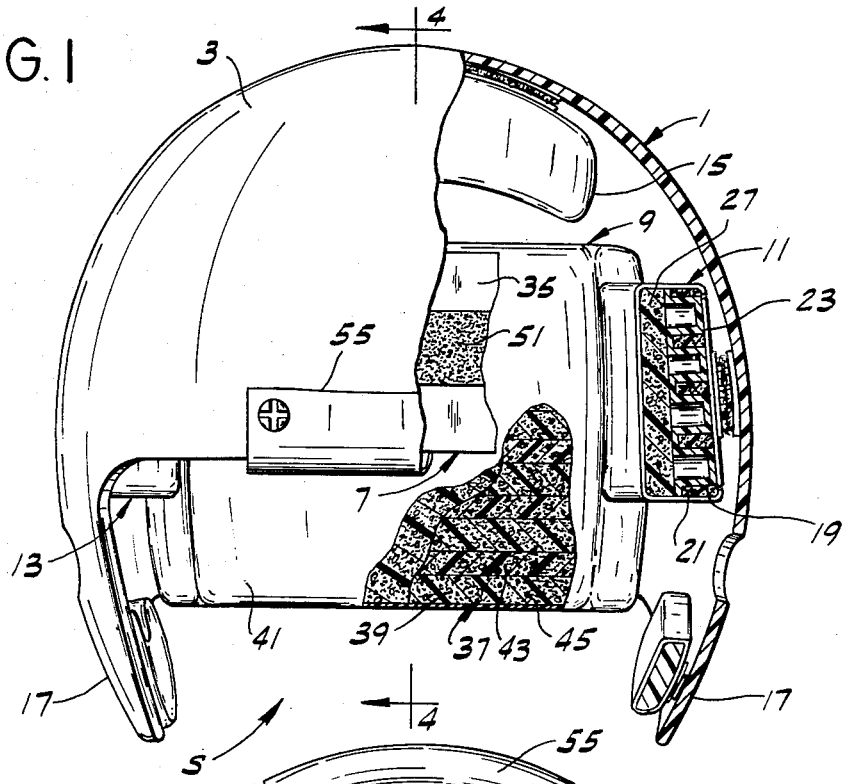
FIG. 1 is a front view of a protective helmet having a shock attenuation system comprising shock attenuation structures of the present invention, portions of the helmet and shock attenuation system being broken away for purposes of illustration.

Referring now to the drawings, there is generally indicated at 1 protective apparatus in the form of headgear (a football helmet as shown) comprising an outer impact-receiving member or shell 3, which may be of a suitable substantially rigid material, such as resin-impregnated fiberglass, having a relatively high resistance to impact. A shock attenuation system of this invention, generally designated S, is provided on the inside of the shell for attenuating the shock on the head resulting from an impact (or impacts) on the shell.

As incorporated in the headgear shown in the drawings, the shock attenuation system S comprises five separate shock attenuation modules or pads 7, 9, 11, 13 and 15 secured to the interior surface of the shell 3 at positions corresponding to the front (forehead), back, left and right sides, and top of the head, respectively. The two pads 11, 13 at the sides of the helmet are generally rectangular in shape and curved to conform to the inside surface of the shell. They are located above the ear flaps 17 of the helmet and are constructed in accordance with the invention described in co-assigned U.S. Pat. No. 4,558,470.

Figure 4:
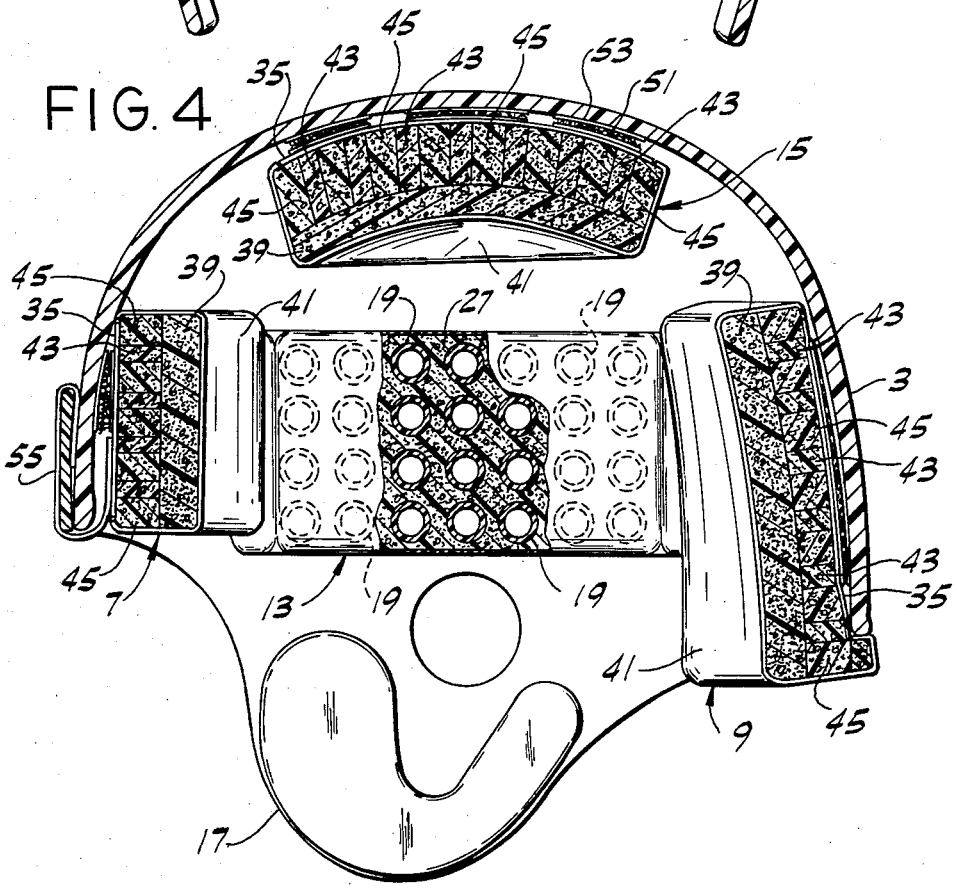
FIG. 4 is a vertical section on line 4—4 of FIG. 1, with portions broken away.

More specifically, each side pad 11,13 contains a plurality of shock attenuating columns 19 integrally molded with and projecting outwardly toward the shell 3 from one face of a carrier sheet 21, the columns being disposed with their axes generally at right angles to the shell. The columns 19 are arrayed on the carrier sheet in a plurality of generally parallel rows (e.g., four rows of seven columns each as shown in FIG. 4), the spacing between adjacent columns in a row and the spacing between adjacent rows of columns being substantially equal. Each column is tubular in shape, open at its inner end, closed at its outer end, and formed of a substantially resilient elastomeric material, such as vinyl, urethane, or polyethylene. All of the columns in the array are of substantially uniform diameter and length and have square-cut ends, i.e., the ends of each column lie in planes generally perpendicular to the central axis of the column.

Each of the two side pads 11, 13 further comprises an outer facing layer 23 of a suitable fabric, for example, adjacent the interior surface of the shell 3, a relatively thick layer 27 of cushioning material, such as a vinyl nitrile foam of the type sold under the trade designation "326 Rubatex" by Rubatex Corporation of Bedford, Va., a separate layer 29 of cushioning material, and an inner facing layer 31 of suitable material, such as leather, engageable by the head of a person wearing the helmet. The carrier sheet 21 is disposed between layers 27 and 29 and the columns 19 project outwardly from the carrier sheet through the cushioning layer 27, the latter of which has a thickness generally equal to the length of the columns.

Side pads 11 and 13 are designed to attenuate the shock on the sides of the head of the wearer resulting from an impact on the shell. It will be noted in this regard that the columns 19 of each side pad are disposed for axial loading during impact and are so dimensioned and configured that, when subjected to an axial impact force of predetermined magnitude, they are adapted resiliently to deform for attenuating the shock resulting from the force of impact. During the initial stages of such deformation, the columns are believed to compress axially, that is, their effective length as measured in the direction perpendicular to the carrier sheet 21 decreases. This decrease is believed to be effected by a bending of the column walls without a substantial increase in the density of the wall material, although it is possible that some actual increase in wall density may occur. During the latter stages of the deformation process, the columns deflect laterally or buckle under the force of impact. This buckling is on a random basis and usually begins with a local crippling at some part of each column. After the impact force has dissipated, the columns are then adapted to spring back substantially to their undeformed (FIG. 1) shape.

Figure 2:
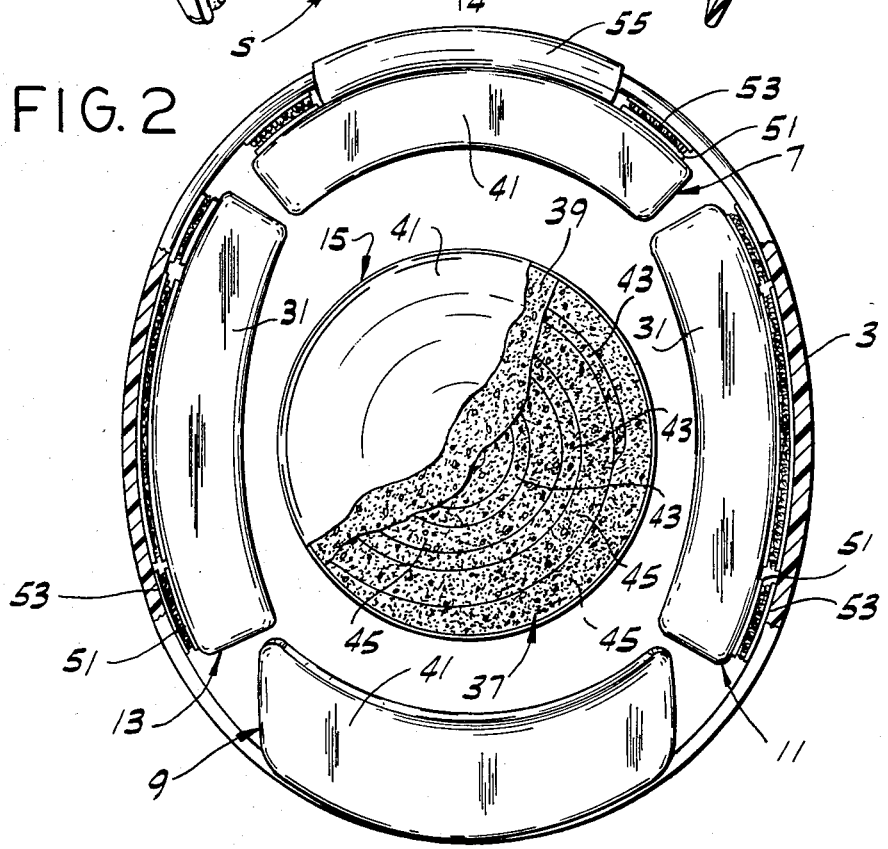
FIG. 2 is a bottom view of the helmet shown in FIG. 1 showing, among other things, a shock attenuation structure at the crown of the shell, portions of the structure being broken away to illustrate details.
Figure 3:
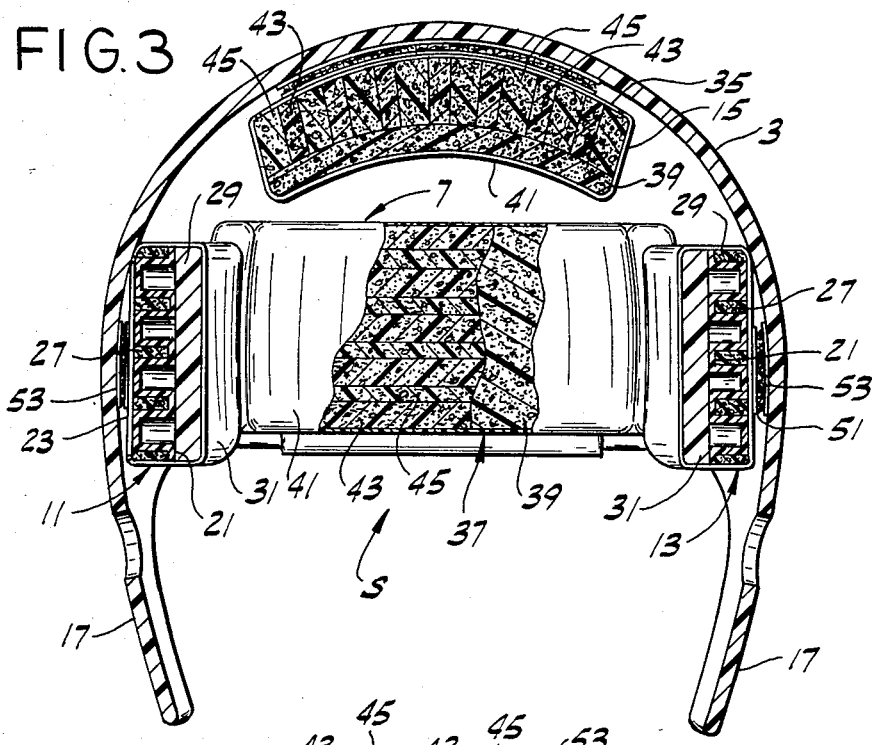
FIG. 3 is a vertical section taken through the helmet in side-to-side direction with portions broken away.

As shown, the front and back pads 7, 9 have a construction different from the side pads 11, 13 described above. Both pads are generally rectangular in shape and, like side pads 11 and 13, are curved to conform to the inside surface of the shell, as shown in FIG. 2. Each pad comprises an outer facing layer 35 of fabric, for example, facing the inside surface of the shell, a central shock attenuating structure, generally designated 37, a layer 39 of cushioning material (e.g., a vinyl nitrite foam of the type described above with respect to layer 27 of side pads 11, 13) and an inner facing layer 41 of leather, for example, encasing the sides of the pad and the inner face of the pad, the latter of which is engageable by the head of a person wearing the helmet.

In accordance with this invention, and as illustrated best in FIG. 4, the central shock attenuation structure 37 of each of the front and back pads 7,9 has a breadth (width) greater than its thickness and a breadthwise (widthwise or vertical as shown in the drawings) cross section comprising a series of layers arranged in contiguous side by side relation, the layers being formed by a first plurality of strips, each designated 43, of shock-absorbing material having a relatively high resistance to compression, and a second plurality of strips, each designated 45, of shock-absorbing material having a lower resistance to compression. Layers 45 alternate with layers 43 across the breadth (width) of the structure 37 (vertically as shown in FIG. 4). Strips or layers 43 are preferably of a resilient material, such as a high-density relatively slow-recovery foam. Strips or layers 45 are also preferably of a resilient material, such as a low-density relatively fast-recovery foam. Strips 43 and 45 are suitably joined together at their sides to form a unitary structure. Strips 43 and 45 may be bonded together by adhesive, for example, such as a polyurethane adhesive sold under the trade designation M6586 by Midwest Chemical Company of St. Louis, Mo.

Figure 5:
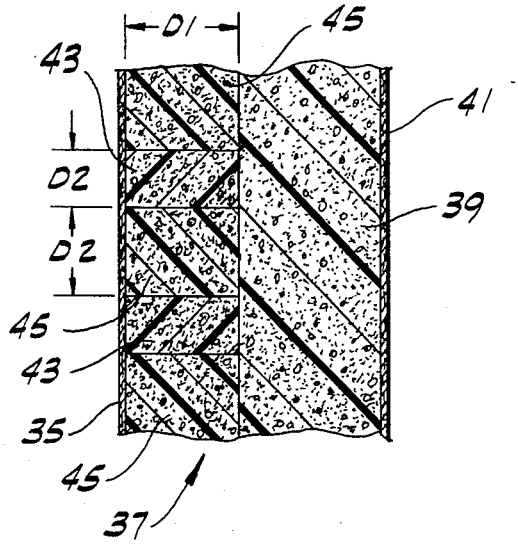
FIG. 5 is an enlarged portion of FIG. 4 showing a shock attenuation structure of this invention.
Figure 6:
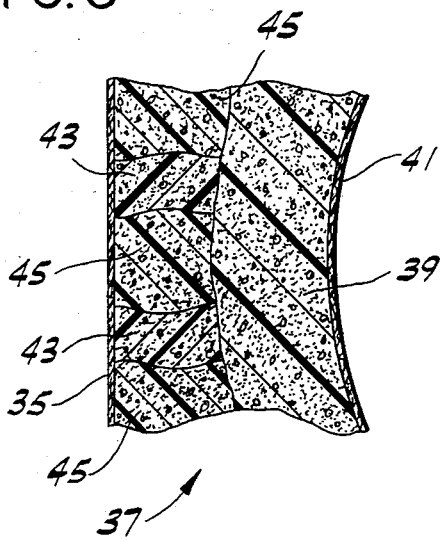
FIG. 6 is a view similar to FIG. 5 showing the shock attenuation structure when subjected to an impact force.

As viewed in cross-section taken breadthwise (widthwise or vertically as shown in FIGS. 4–6) with respect to structure 37, layers 43 and 45 are generally rectangular, each layer having a major dimension D1, constituting its height, and a minor dimension D2, constituting its width or thickness, less than D1. The layers are arranged with their major dimensions D1 generally parallel and extending generally in the direction of the thickness of the structure so that the height of the layers generally corresponds to the thickness of the structure. When the pads 7,9 are mounted on the shell in the manner shown, the major dimension D1 of the layers extends generally at right angles to the inside surface of the shell so that the breadth of the pad is generally perpendicular to the direction of impact force for broadside loading of the structure during an impact.

When loaded, as during an impact to the front or back of the shell 3, the layers 43,45 of a respective pad 7, 9 are adapted to deform in the area of impact for attenuating the shock resulting therefrom. Since layers 43 are of a material having a relatively high resistance to compression, they will absorb most of the impact force by compressing and by deflecting laterally, as shown in FIG. 6. However, layers 45 also absorb some impact force. More importantly, layers 45 provide substantial lateral support to layers 43 and thereby increase the latter's ability to resist lateral deflection and thus to attenuate shock. The lateral support provided by layers 45, together with the fact that layers 43 are preferably of a relatively slow-recovery material, minimizes the "rebound effect" (i.e., the shock felt by the wearer as the shock-absorbing material returns to its undeformed state).

Top pad 15 has a construction similar to that of front and back pads 7 and 9, and corresponding parts are designated by the same reference numerals. The principle difference between pad 15 and pads 7 and 9 is that the structure 37 of pad 15, instead of being formed by numerous relatively narrow strips joined together side by side, is formed by only two such strips joined (e.g., adhesively bonded) at their sides and coiled in spiral form, one strip of the pair, as coiled, forming layers 43 and the other strip of the pair, as coiled, forming layers 45. The convolutions of the coiled strips are also joined (as by adhesive bonding) to form a unitary structure. Structure 37 of pad 15 functions to a attenuate shock in the same manner as structure 37 of pads 7 and 9. Pad 15 is slightly dished in shape to conform to the crown contour of the helmet.

An important advantage of this invention is that, given a set of design parameters, the system S may be engineered to meet virtually any performance requirement over a wide range of requirements. With respect to pads 7, 9 and 15, for example, this may be accomplished by varying the physical properties and characteristics of layers 39 and 41, such as the materials out of which they are made, and the cross-sectional dimensions of the layers. For example, the construction of most football helmets is such that the pad 7 at the front of the helmet is often subjected to greater loads than the back and top pads 9 and 15. Accordingly, layers 43 and 45 of pad 7 are preferably of relatively stiff materials for more effectively absorbing the greater loads. By way of example, layers 43 could be of a high-density relatively slow-recovery polyurethane adhesive, such as is available from Midwest Chemical Company of St. Louis, Mo. under the trade designation M6586, and layers 45 of a high-density (e.g., 2–4 lbs/ft.$^3$) relatively slow-recovery foam such as an ionomer sold under the trade designation "Surlyn" by Gilman Brothers Company of Gilman, Conn. Alternatively, front pad 7 could have a construction identical to the side pads 11, 13. In the back and top pads 9, 15, which may not need to be as stiff as the front pad 7, layers 43 could be of a high-density (e.g., 12 lbs/ft$^3$) relatively slow-recovery foam such as an ionomer sold under the trade designation "Surlyn" by Gilman Brothers Company of Gilman, Conn., and layers 45 could be a low-density (e.g., 2–4 lbs/ft$^3$) relatively fast-recovery foam such as ethylene vinylacetate sold under the trade designation "Evalite" by Monarch Rubber Co. of Bolt, Md. Several additional examples of resilient materials which have been found suitable for use in a protective helmet application are given below.

Layers 43

1. 0.020"–0.030" thick polycarbonate film of the type sold under the trade designation "Lexan" by General Electric Company of Pittsfield, Mass.
2. 0.020"–0.040" thick polycarbonate PET film such as sold by the Plastics and Coatings Division of Mobay Chemical Corporation of Rosemont, Ill.
3. 0.020"–0.060" thick polyethylene film having a density in the range of about 70–90 lbs/ft$^3$.
4. 0.020"–0.060" thick polyurethane film having a density in the range of about 80–100 lbs/ft$^3$.

Layers 45

1. Polyurethane foam of the type sold under the trade designation "Poron" by Rogers Corporation of Rogers, Conn., having a density in the range of about 4–12 lbs/ft$^3$.
2. Vinyl nitrile foam of the type sold under the trade designation "326 Rubatex" by Rubatex Corporation of Bedford, Va.
3. Cross-linked polyethylene foam of the type sold under the trade designation "Ensifoam" by Uniroyal Plastic Products of Warsaw, Ind., and under the trade designation "Volara" by Voltek, Inc. of Lawrence, Mass., having densities in the range of about 4–12 lbs/ft$^3$.

While the materials discussed above are resilient, the use of permanently-deformable non-resilient materials to fabricate layers 43 and/or 45 is also contemplated, at least under certain circumstances, as where the impact loadings are at very high levels. Under such conditions, it has been found that layers 43, for example, may be formed by strips of paper or thin slices of wood.

As alluded to above, the cross-sectional dimensions of layers 43 and 45 are also believed to have an important effect on the ability of structure 37 to absorb and attenuate shock. It is believed, for example, that for maximum effectiveness in attenuating shock, layers 43 should have a slenderness ratio (i.e., the ratio of D1/D2) of 1.0 or greater, so that the layers will not only compress but also tend to buckle (as viewed in cross section) under loading to more effectively absorb the energy of impact. Generally speaking, as the impact load increases, the slenderness ratio of layers 43 should also increase and layers 43 should be formed from materials having a higher resistance to compression in the direction of the loading, thus making structure 37 stiffer for more effectively absorbing the higher impact energies involved. With respect to layers 45, they too should generally have a slenderness ratio of 1.0 or greater, with the slenderness ratio increasing as the impact load increases.

Each pad 7, 9, 11, 13 and 15 is removably mounted on the inside of shell 3 by fastening means comprising one or more two-part fasteners, one part, in the form of a patch 51, of each fastener being secured (e.g., glued) to the respective outer faces 23 or 35 of the pads, and the other part, in the form of a patch 53, of each fastener being secured (e.g., glued) to the interior surface of the shell 3. The two patches 51, 53 of each fastener are preferably formed from a fabric fastening material available commercially under the trademark VELCRO, such as shown in Mestral U.S. Pat. No. 2,717,431, issued Sept. 13, 1955. Thus the patches have cooperable fastening elements thereon which are interengageable for fastening the pad to the shell, and disengageable for removal of the pad from the shell (as for inspection and replacement, if necessary). It will be understood that additional VELCRO patches 53, or even continuous VELCRO strips may be placed around the interior surface of the shell so that the position of the pads may be adjusted to fit the head of the particular person wearing the headgear. The front pad 7 is further secured to the helmet by a strip of webbing 55 fastened to the outer surface of the helmet at its front. Other means for fastening the pads to the helmet may also be used.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A shock attenuation structure having a breadth greater than its thickness and a breadthwise cross section comprising a series of layers arranged side-by-side, said series comprising a first plurality of layers of shock-absorbing material having a relatively high resistance to compression and a second plurality of layers of shock-absorbing material having a lower resistance to compression, the layers of said first and second pluralities being disposed in contiguous side-by-side relation across substantially the entire breadth of the structure to form a substantially unitary structure, the layers of said second plurality alternating with the layers of said first plurality across the breadth of the structure and providing lateral support to the layers of said first plurality, said structure being adapted to be mounted with its breadth generally perpendicular to the direction of impact force for broadside loading of the structure during an impact, said layers of said first and second pluralities in the area of impact being adapted to deform for attenuating the shock resulting from said impact, with said layers of said second plurality providing lateral support to the layers of said first plurality during said impact.

2. A shock attenuating structure as set forth in claim 1 wherein each layer of said first plurality of layers has a major dimension, constituting its height, and a minor dimension, constituting its width or thickness, less than said major dimension, the layers of said first plurality of layers being arranged with their major dimensions generally parallel and extending generally in the direction of the thickness of said structure whereby the major dimension of one layer generally corresponds to the thickness of said structure.

3. A shock attenuating structure as set forth in claim 2 whereby the slenderness ratio of each layer of said first plurality of layers is 1.0 or greater, the slenderness ratio being the ratio of the height of the layer in cross section to its width in cross section.

4. A shock attenuation structure as set forth in claim 3 wherein the layers of said first plurality of layers are generally rectangular in cross section.

5. A shock attenuation structure as set forth in claim 4 wherein the layers of said first plurality of layers are of a high-density relatively slow-recovery foam.

6. A shock attenuation structure as set forth in claim 5 wherein each layer of said second plurality of layers has a major dimension, constituting its height, and a minor dimension, constituting its width or thickness, the height of the layers of said second plurality of layers being substantially the same as the height of the layers of said first plurality of layers.

7. A shock attenuation structure as set forth in claim 6 wherein the layers of said second plurality of layers are of a low-density relatively fast-recovery foam.

8. A shock attenuation structure as set forth in claim 1 wherein said structure comprises a series of relatively narrow strips joined together side-by-side, said series comprising a first plurality of strips corresponding to said first plurality of layers and a second plurality of strips corrsponding to said second plurality of layers.

9. A shock attenuation structure as set forth in claim 8 wherein said strips are bonded to one another at their sides to form a unitary structure.

10. A shock attenuation structure as set forth in claim 9 wherein said strips are adhesively bonded.

11. A shock attenuation structure as set forth in claim 1 wherein said structure comprises a pair of relatively narrow strips joined at their sides and coiled in spiral form, one strip of said pair, as coiled, forming said first plurality of layers and the other strip of said pair, as coiled, forming said second plurality of layers.

12. Protective apparatus for the head comprising a shell of substantially rigid material adapted to fit on the head and a plurality of separate shock attenuating modules disposed around the inside of the shell for protecting the head, at least one of said modules comprising a shock attenuating structure having a breadth greater than its thickness and a breadthwise cross section comprising a series of layers arranged side-by-side, said series comprising a first plurality of layers of shock-absorbing material having a relatively high resistance to compression and a second plurality of layers of shock-absorbing material having a lower resistance to compression, the layers of said first and second pluralities being disposed in contiguous side-by-side relation across substantially the entire breadth of the structure to form a substantially unitary structure, the layers of said second plurality alternating with the layers of said first plurality across the breadth of the structure and providing lateral support to the layers of the first plurality, said structure being mounted on the inside of the shell with its breadth generally perpendicular to the direction of impact force for broadside loading of the structure during an impact, said layers in the area of impact being adapted resiliently to deform for attenuating the shock resulting from said impact, with said layers of said second plurality providing lateral support to the layers of said first plurality during said impact.

13. Protective apparatus as set forth in claim 12 wherein each layer of said first plurality of layers has a major dimension, constituting its height, and a minor dimension, constituting its width or thickness, less than said major dimension, the layers of said first plurality of layers being arranged with their major dimensions generally parallel and extending generally in the direction of the thickness of said structure whereby the major dimension of one layer generally corresponds to the thickness of said structure.

14. Protective apparatus as set forth in claim 13 wherein the slinderness ratio of each layer of said first plurality of layers is 1.0 or greater, the slenderness ratio being the ratio of the height of the layer in cross section to its width in cross section.

15. Protective apparatus as set forth in claim 14 wherein the layers of said first plurality of layers are generally rectangular in cross section.

16. Protective apparatus as set forth in claim 15 wherein the layers of said first plurality of layers are of a high-density relatively slow-recovery foam.

17. Protective apparatus as set forth in claim 16 wherein each layer of said second plurality of layers has a major dimension, constituting its height, and a minor dimension, constituting its width or thickness, the height of the layers of said second plurality of layers being substantially the same as the height of the layers of said first plurality of layers.

18. Protective apparatus as set forth in claim 17 wherein the layers of said second plurality of layers are of a low-density relatively fast-recovery foam.

19. Protective apparatus as set forth in claim 12 wherein said structure comprises a series of relatively narrow strips joined together side-by-side, said series comprising a first plurality of strips corresponding to said first plurality of layers and a second plurality of strips corresponding to said second plurality of layers.

20. Protective apparatus as set forth in claim 19 wherein said strips are bonded to one another at their sides to form a unitary structure.

21. Protective apparatus as set forth in claim 20 wherein said strips are adhesively bonded.

22. Protective apparatus as set forth in claim 12 wherein said structure comprises a pair of relatively narrow strips joined at their sides and coiled in spiral form, one strip of said pair, as coiled, forming said first plurality of layers and the other strip of said pair, as coiled, forming said second plurality of layers.

23. Protective apparatus as set forth in claim 22 further comprising means for mounting said spiral structure at the crown of the shell for protecting the top of the head, said spiral structure being dished for conforming to the crown of the shell.

* * * * *